United States Patent [19]

Straus

[11] Patent Number: 4,494,273

[45] Date of Patent: Jan. 22, 1985

[54] SWING CONTROL HINGE

[76] Inventor: Albert E. Straus, 1643 W. 8th St., Erie, Pa. 16505

[21] Appl. No.: 423,817

[22] Filed: Sep. 27, 1982

[51] Int. Cl.[3] ..... E05F 3/20

[52] U.S. Cl. ..... 16/50; 16/72; 16/85; 16/278; 16/301; 16/303

[58] Field of Search ..... 16/50, 85, 86 R, 86 A, 16/298, 299, 301, 339, 303, 304, 307, 341, 342, 386, 278, 279, 284, 285, 295, 296, 301, 72

[56] References Cited

U.S. PATENT DOCUMENTS

| | | | |
|---|---|---|---|
| 1,155,867 | 10/1915 | Allgier | 16/50 |
| 3,098,258 | 7/1963 | Ruiz | 16/50 |
| 3,349,427 | 10/1967 | Cairns et al. | 16/273 |

*Primary Examiner*—Fred A. Silverberg
*Attorney, Agent, or Firm*—Charles L. Lovercheck; Wayne L. Lovercheck; Dale R. Lovercheck

[57] ABSTRACT

The swing control hinge disclosed is intended to control the rotational speed of a door that is tending to accelerate toward the strike as a result of spring loaded hinges. The hinge is intended to prevent slamming of the door while allowing enough speed to insure latching. The swing control hinge is housed in a hinge body that may be used as a third hinge. The hinge pin is made up of two cams that have cam parts on them which dissipate energy from conventional spring loaded hinges having helical spring or a block of rubber during the opening cycle of the door and the torsional force from the spring loaded hinges is dissipated in checking the door as it closes to keep the door from slamming.

14 Claims, 7 Drawing Figures

FIG. 4
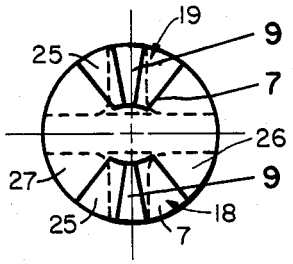
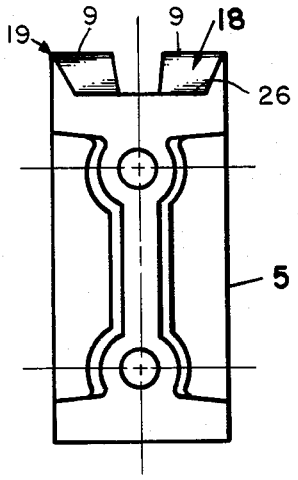
FIG. 5
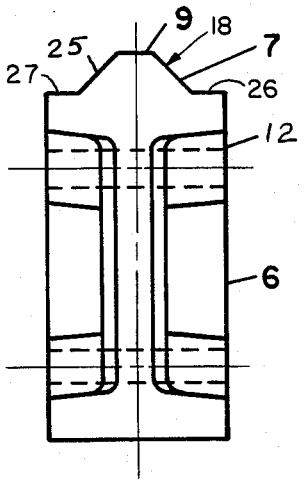
FIG. 6

SWING CONTROL HINGE

GENERAL STATEMENT OF INVENTION

The device disclosed herein is designed to control the rotational speed of a door that is tending to accelerate toward the strike as a result of spring loaded hinges. Spring loaded hinges are becoming more popular because of their economy but they result in undesirable slamming of the door because of the aforementioned acceleration. They are usually installed in one or two of the butt pairs of hinges on the door. The device described herein is housed in a third butt pair and decelerates the closing speed of the door thereby eliminating the slamming while allowing enough speed to insure latching. Thereby the swing control hinge works in a system with spring loaded hinges to provide a controlled door closing swing in a much more economical manner than the common hydraulic door closer.

The advantages of the invention disclosed herein are related to cost saving. The most significant of these is that the controlling elements are housed in a conventional butt pair. This is an economical housing and they are commonly manufactured. Further, this means that there is no installation expense incurred because the third butt pair must be installed in any event. Also the internal parts are two simple moldings held in place by roll pins and backed by a conventional compression spring or other resilient body. All these parts are economical and easy to assemble. In replacing the hydraulic door closure, not only is the labor cost of installing the door closure avoided by the asthetics of the door are improved by its absence. There is no visible evidence that the swing control device is installed because no add-on component is required.

REFERENCE TO PRIOR ART

Applicant is aware of no prior art in connection with the invention disclosed herein.

U.S. Pat. No. 1,141,782 shows a hinge in which a cam surface causes a door to accelerate to closed position and a helical spring creates a return spring action. U.S. Pat. No. 3,284,842 shows a hinge with a resilient hinge pin. Other patents of interest are:

U.S. Pat. No. 1,867,346
U.S. Pat. No. 3,107,758
U.S. Pat. No. 3,349,427
U.S. Pat. No. 3,820,866
U.S. Pat. No. 3,930,594

OBJECTS OF THE INVENTION

It is an object of the invention to provide a device to control the rotational speed of a door that is simple in construction, economical to manufacture and simple and efficient to use.

Another object of the invention is to provide a door check device that is simple in construction, economical to manufacture and simple and efficient to use.

Another object of the invention is to provide an improved door checking device.

Another object of the invention is to provide a door checking device in combination with a door supported on spring loaded hinges.

Another object of the invention is to provide radial positioning so that when the door is almost closed it is off the cam allowing the remaining torque movement to bring the door to latching speed without slamming.

With the above and other objects in view, the present invention consists of the combination and arrangement of parts hereinafter more fully described, illustrated in the accompanying drawing and more parrticularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

FIG. 4 is a top view of the cam taken at 90° to the view shown in FIG. 5.

FIG. 5 is a side view of one of the cams.

FIG. 6 is a view taken at 90° to FIG. 5.

DETAILED DESCRIPTION OF THE DRAWINGS

Figure 1:
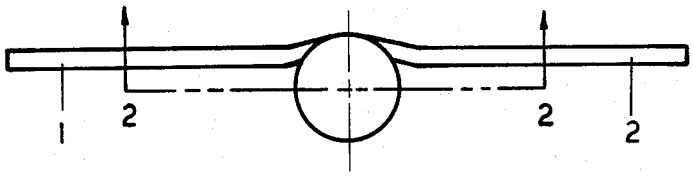
FIG. 1 is a top view of one of the cam members used in the hinge and cam according to the invention.

When a door such as door 24 is hung with spring loaded hinges 21 and 22 and the door is opened, a torque moment is built up in the springs. When the door is released, the torque is dissipated so that the further the door swings toward closure, the faster its rotational speed and the lesser its torque moment. In order to introduce a deceleration force, applicant has provided a system of radially faced cams 5 and 6, axially positioned helical compression spring 114 or an elastomer 14 and an adjustment means was devised. The system according to the invention was designed to be housed within the confines of the knuckles of standard hinge butts with minimal modifications. Each butt 1 and 2 has two knuckles or barrels 3 and 4 that interfit. One butt 1 is affixed to the door 24 and the other butt 2, is fixed to the stile 23. Therefore, if a door 24 is opened or closed, relative rotational motion is present. To control the speed of that rotational motion, two virtually identical cams 5 and 6 co-act to introduce an interference at a predetermined degree in rotation and force of the door thereby allowing the door to swing through a predetermined path while the cam lobes are not in an engagement with one another. The configuration of these cams 5 and 6 and their positioning allows the predetermined conditions of door swing retarding to be met. The elastomer is hour glass shaped to provide space in the hinge knuckle into which the elastomer can be distorted when compressed.

The lobes 18 and 19 are generally wedge shaped with a second flat surface 9 joining flat inclined surfaces 7 and 25. The elements of configuration are the slope of the first inclined surfaces 7, the height 8 of the lobes 18 and 19, and the surface 9 at the top of the lobes 18 and 19. Each of the cams 5 and 6 have the relatively flat first cam surfaces 26 and 27 that lie in a plane that is perpedicular to the axis of the cam members 5 and 6. The slope of the second cam surfaces 7 and 25 determines how gradually the deceleration force is introduced and withdrawn from the natural rotational forces set up by the spring hinges. The height of the cam lobe contributes to determining how much force is introduced. The top surfaces 9 of the lobes determines the length of time maximum deceleration force is introduced. The overall configuration is designed so that maximum radial surface is in contact in all positions to distribute the load and reduce wear potential.

Figure 2:
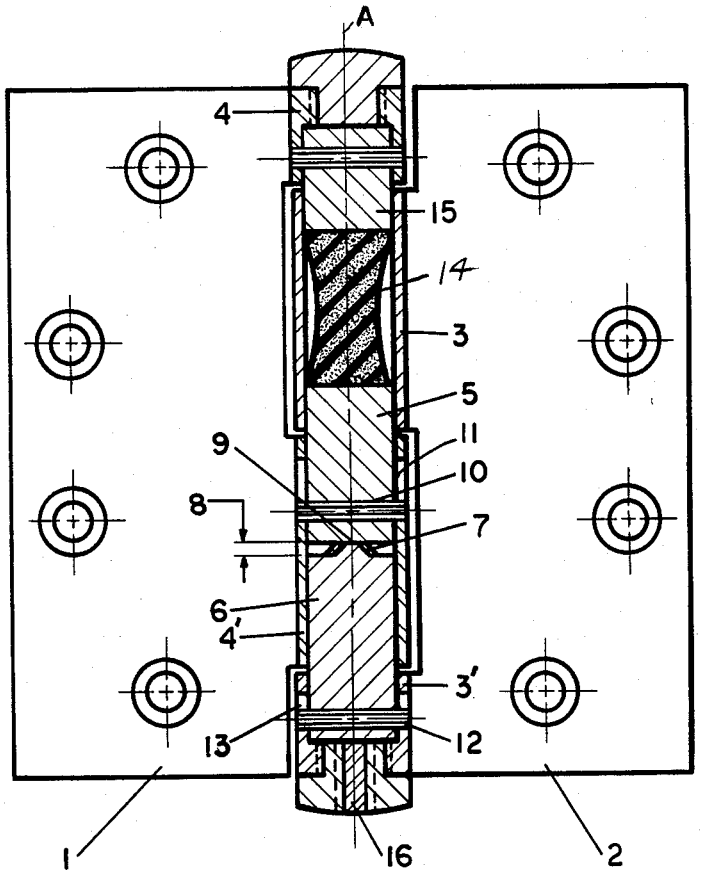
FIG. 2 is a longitudinal cross sectional view of the door checking device according to the invention.
Figure 3:
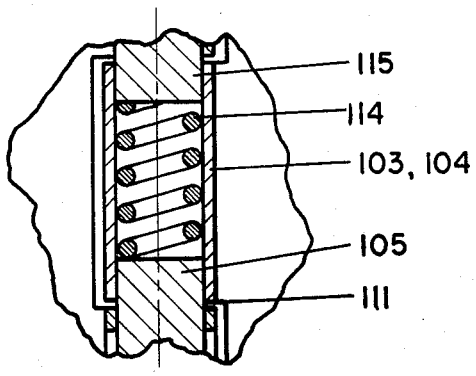
FIG. 3 is an enlaged partial view of another embodiment of the hinge cam shown in FIG. 2.
Figure 7:
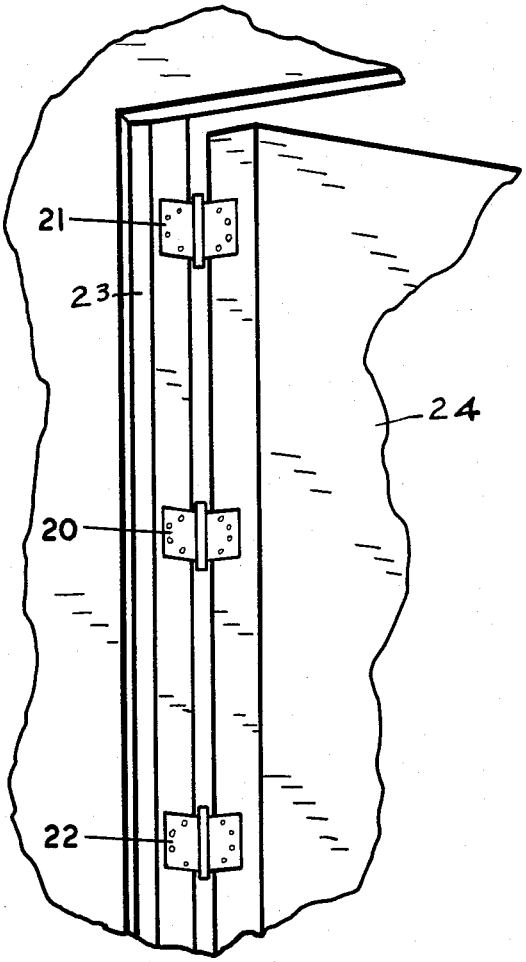
FIG. 7 is a view of the hinge according to the invention shown on a door together with two hinges that spring the door toward closed position.

While this device is reversible, for purposes of explanation, let us identify cam 5 as that which is affixed to the door. Each cam has two pin holes for the pins 10 and 12 so that the cams 5 and 6 are interchangeable. Both pin holes are shown in the detail of FIGS. 5 and 6. The unused pin hole is not shown in FIG. 2. This is accomplished by means of a simple roll pin 10, or similar device which extends outwardly from the outside diameter of the cam and its extensions engage two opposed slots in the lower barrel of the door butt 1. The slots 11 cause the cam 5 to rotate with the door and limits its axial travel. The other cam 6 is similarly affixed to the stile through another pin 12 working in a slot 13 in the lower barrel of the stile butt 2.

As a further control on the amount of deceleration force, a compression or compressible material such as an elastomer or resilent means 14 is positioned above cam 5. During the closing motion of the door from open to closed position, the door may be considered to move through a sequence of a first, a second, a third and a fourth path of movement. During the first path of movement, the first flat cam surface 26 on cam member 5 is engaged by the second flat cam surface 9 on cam member 6. The second flat cam surface 27 on cam member 5 is engaged by the second cam surface 9 on lobe 19 of the second cam 6. During this first path of travel of the door no compressive force is exerted on the resilient member 14. During the second path of movement, as the door approaches closed position, the inclined cam surface 7 on first cam member 5 engages the first inclined cam surface 25 on cam member 6, causing the cam member 5 to move axially in its barrel 3' and 4' pressing the resilient member 14 and decelerating the door. During a third path of movement, the second flat surfaces 9 on the first cam member 5 will engage the second flat surfaces 9 on the second cam member 6 introducing no additional compression on the resilient member 14 during the third path of movement of the door. At the end of the third path, as the surface 9 on the cam members 5 pass the surfaces 9 on the cam member 6, the second inclined surface 25 on the cam member 5 will slide down the second inclined cam surface on the cam member 6 thereby accelerating the door, through the fourth path of movement, toward the final latching position during the fourth path of movement. This provides axial force in the appropriate amount for the size and weight of the door. The spring is backed up by a solid cylinder 15 which is cored out at its edges for economy of material. The cylinder 15 spans the gap between the knuckles as the two cams do, providing hinge alignment the way a conventional hinge pin would do.

Finally, at the bottom of the assembly, there is a set screw 16 which fine-tunes the adjustment. For example, if a heavier door was to be controlled, the set screw 16 would be advanced axially raising the cam assembly and adding pre-compression to the spring 114 or elastomer 14.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A swing control hinge comprising a first butt (1), a second butt (2), pivot means (5, 6, or 15) swingably connecting said first butt (1) to said second butt (2) to swing about an axis (A), said first butt (1) being adapted to be connected to a door (24) having means to accelerate said door (24) toward closed postion, said second butt (2) being adapted to be connected to a door stile (23), a first cam member (5), means supporting said first cam member (5) on said first butt (1), a second cam member (6), means supporting said second cam member (6) on said second butt (2), a first flat cam surface (26) on said first cam member (5), said first cam surface being deposed in a plane perpendicular to said axis (A), first lobe means (18,) on said first cam member (5), said first lobe means (18) having a first flat inclined surface (7) extending from said first flat cam surface (26) toward said second cam member (6), a first flat cam surface (26) on said second cam member (6), said first cam surface being disposed in a plane perpendicular to said axis (A), second lobe means (18) on said second cam member (6) having an inclined flat surface (7) extending from said first flat surface (26) on said second cam member (6) toward said first cam member (5), resilient means (14) supported on said hinge between said first cam member (5) and said pivot means (15), said first butt (1) being adapted to swing with said door (24) from an open position through a first predetermined path and a second predetermined path toward a closed position, said first flat cam surface (26) on said first cam member (5) being adapted to engage said second lobe means (18) on said second cam member (6) as said door swings through said first predetermined path whereby no compressive force is exerted on said resilient means as said door swings through said first predetermined path, said first flat inclined surface (7) of said first lobe means (18) engaging said first flat inclined surface (7) on said second cam member (6) when said door swings through said second predetermined path whereby the compressive force on said resilient means is increased to decelerate the door; wherein said first lobe means (18) has a second flat surface (9) disposed in a plane parallel to said first flat surface (26) and spaced therefrom, said lobe means on said second cam member is adapted to move along said second flat surface as said door moves through a third path, maintaining compression on said resilient member (14), wherein said first cam member (5) has a third flat surface (27) coplaner with said first flat surface and said first lobe means has a second inclined surface extending from said second flat surface (9) radially outwardly of said first cam member to said third flat surface, said second lobe means has a second flat surface (9) disposed in a plane parallel to said first flat surface and spaced therefrom, said second cam has a third flat surface (27) disposed in a common place with said first flat surface, said second lobe means further comprising a second inclined surface extending from said second flat surface (9) to said third flat surface (27), said first cam member and said second cam member being slidable along said axis, the second flat surfaces (9) on the first cam member (5) engage the second flat surfaces (9) on the second cam member (6) introducing no additional compression on the resilient means (14) during the third path of movement of the door and at the end of the third path, as the surface (9) on the first cam member (5) passes the surface (9) on the second cam member (6), the second inclined surface (25) on the second cam member (6) thereby accelerating the door through a fourth path of movement toward a final latching position.

2. The hinge recited in claim 1 wherein said cam members are generally cylindrical in configuration.

3. The hinge recited in claim 2 wherein said first butt (1) has a first barrel (4) thereon having a first cylindrical hollow therein, said second butt (2) has a second barrel (3) thereon said second barrel (3) having a second cylindrical hollow therein, said first hollow and said second hollow being concentric to each other, said pivot means (15) being received in said first hollow and extending into said second hollow.

4. The hinge recited in claim 3 wherein said first butt (1) has a third barrel (3') integral therewith, having a third cylindrical hollow, said second but (2) has a fourth barrel (4'), having a fourth cylindrical hollow therein, said second cam member (6) is received in said second hollow and extends into said fourth hollow comprising said pivot means (15) for said first butt (1) and said second butt (2).

5. The hinge recited in claim 4 wherein said second cam member (6) is received in said second hollow and extends into said third hollow into engagement with said first cam member (5).

6. The hinge recited in claim 5 wherein said first butt (1) has a fourth barrel and a cylindrical member (15) comprising said pivot means, said cylindrical member (15) is received in said fourth barrel and said second barrel, a first pin is provided, said first pin extending through said third barrel (3') and through said cylindrical member (15) holding said cylindrical member (15) against sliding movement in said first barrel (4) and said third barrel (3').

7. The hinge recited in claim 6 wherein a second pin (10) extends through said first cam member (5) and said first barrel (4), said first barrel (4) has an axially extending slot (11) therein, said second pin (10) extending through said slot (11) and through said second cam member (6) allowing said second cam member (6) to slide relative to said second barrel (3) and to said fourth barrel (4').

8. The hinge recited in claim 7 wherein said resilient means (14) is disposed between said first cam member (5) and said cylindrical member (15), said first cam member (5) being adapted to be moved toward said cylindrical member (15) when said first lobe means (18) on said first cam member (5) engages said second lobe means (18) on said second cam member (6) during the swinging movement of the door through said second path.

9. The hinge recited in claim 8 wherein said resilient member (14) is hourglass in shape.

10. The hinge recited in claim 9 wherein said third pin (12) is received in a second axially extending slot (13) in said fourth barrel (3'), screw means (16) is provided in an end of said hollow in said fourth barrel (4') engaging said second cam member (6) and adapted to adjust said second cam toward said resilient member (14).

11. The hinge recited in claim 10 wherein said resilient means (14) disposed in said second barrel (3) between said cylindrical member (15) and said first cam member (5), said resilient member (14) is compressed between said first cam member (5) and said cylindrical member (15) when said second lobe means (18) on said second cam member (6) engages said first lobe means (18) on said first cam member (5).

12. The hinge recited in claim 11 wherein said resilient member (14) is hourglass shaped.

13. The hinge recited in claim 4, wherein a screw (16) is threadably received in said third barrel (3'), said screw (16) being adapted to move said second cam member (6) and said first cam member (5) toward said cylindrical member (15) thereby introducting a preload stress into said resilient member (14).

14. The hinge recited in claim 1 wherein said resilient means comprises a helical spring.

* * * * *